United States Patent [19]

Holz, deceased et al.

[11] Patent Number: 4,863,589

[45] Date of Patent: Sep. 5, 1989

[54] ELONGATED MEMBER AND COVER FOR USE WITH SIZING SCREEN

[76] Inventors: William G. Holz, deceased, late of Stockton, Calif.; by Edward Dourgarian, executor, 1755 W. Hammer La. #7B, Stockton, Calif. 95209

[21] Appl. No.: 163,518

[22] Filed: Mar. 2, 1988

[51] Int. Cl.[4] ..... B07B 1/00

[52] U.S. Cl. ..... 209/409; 209/412; 248/345.1; 403/376

[58] Field of Search ..... 209/408, 409, 412, 414; 248/345.1; 293/122, 121; 403/356, 359, 319, 376

[56] References Cited

U.S. PATENT DOCUMENTS

| | | | |
|---|---|---|---|
| 267,049 | 11/1882 | Wilson | 209/414 |
| 281,618 | 7/1883 | Crowell | 403/359 |
| 1,370,073 | 3/1921 | Utz et al. | 403/359 |
| 1,519,967 | 12/1924 | Hughes | 293/122 |
| 2,564,386 | 8/1951 | Webb | 248/345.1 |
| 2,858,582 | 11/1958 | Toulmin, Jr. | 403/376 |
| 3,358,725 | 12/1967 | Bussard et al. | 248/345.1 |
| 4,184,783 | 1/1980 | Hall | 403/376 |
| 4,265,388 | 5/1981 | Takahashi | 403/359 |
| 4,733,894 | 3/1988 | Lamparter | 293/122 |

*Primary Examiner*—Joseph J. Rolla
*Assistant Examiner*—Steve Reiss
*Attorney, Agent, or Firm*—Glen R. Grunewald; Thomas R. Lampe

[57] ABSTRACT

A rigid, elongated member and cover of resilient, abrasive resistant material which provides protection for the rigid elongated member are adapted for positioning under a sizing screen. The cover protects the elongated member from sand falling through the sizing screen, thus reducing the amount of damage that the falling sand may inflict on the elongated member due to abrasion, erosion, etc.

2 Claims, 2 Drawing Sheets

ELONGATED MEMBER AND COVER FOR USE WITH SIZING SCREEN

TECHNICAL FIELD

This invention relates to structure for use with a vibrating rock sizing screen, and more particularly, to structure associated with the support for the screen which is disposed below such screen. During the course of the sizing operation the structure is impacted by rock and other material falling through the screen. The structure of the present invention is adapted to resist abrasion, erosion, and other types of damage caused by the material cascading downwardly through the screen.

BACKGROUND ART

Conventionally, vibrating rock sizing screens are supported by structure including steel tubes extending across the screen and below it. Rocks and other material processed through the screen strike the tubes during the sizing operation. Over a period of time this action results in significant damage to the tubes. Eventually the tubes are so weakened by being worn away that they must be replaced.

Replacement of the tubes is often a difficult and time consuming process. In any event, it is an expensive one since not only the direct costs of manpower and equipment are involved, but the cost of down time as well.

DISCLOSURE OF THE INVENTION

According to the teachings of the present invention, and in common with prior art arrangements, a rigid, elongated member is positionable under a shaker screen. In contrast to the prior art, however, such member is protected against abrasion and damage by rocks and other material cascading downwardly through the screen, thus greatly prolonging the operating life of the elongated member.

Protection is provided by a cover formed of resilient, abrasive resistant material, such as rubber, mounted over the elongated member in such a manner as to prevent damage to that portion of the outer peripheral surface of the elongated member which would otherwise be damaged by the falling rock. Specific cooperative structure is provided on the elongated member and the cover which permits ready attachment or detachment therebetween.

Other objectives, advantages, and features of the present invention will be more readily apparent from the following detailed description and with reference to the accompanying drawings.

BEST MODE FOR CARRYING OUT THE INVENTION

Figure 1:
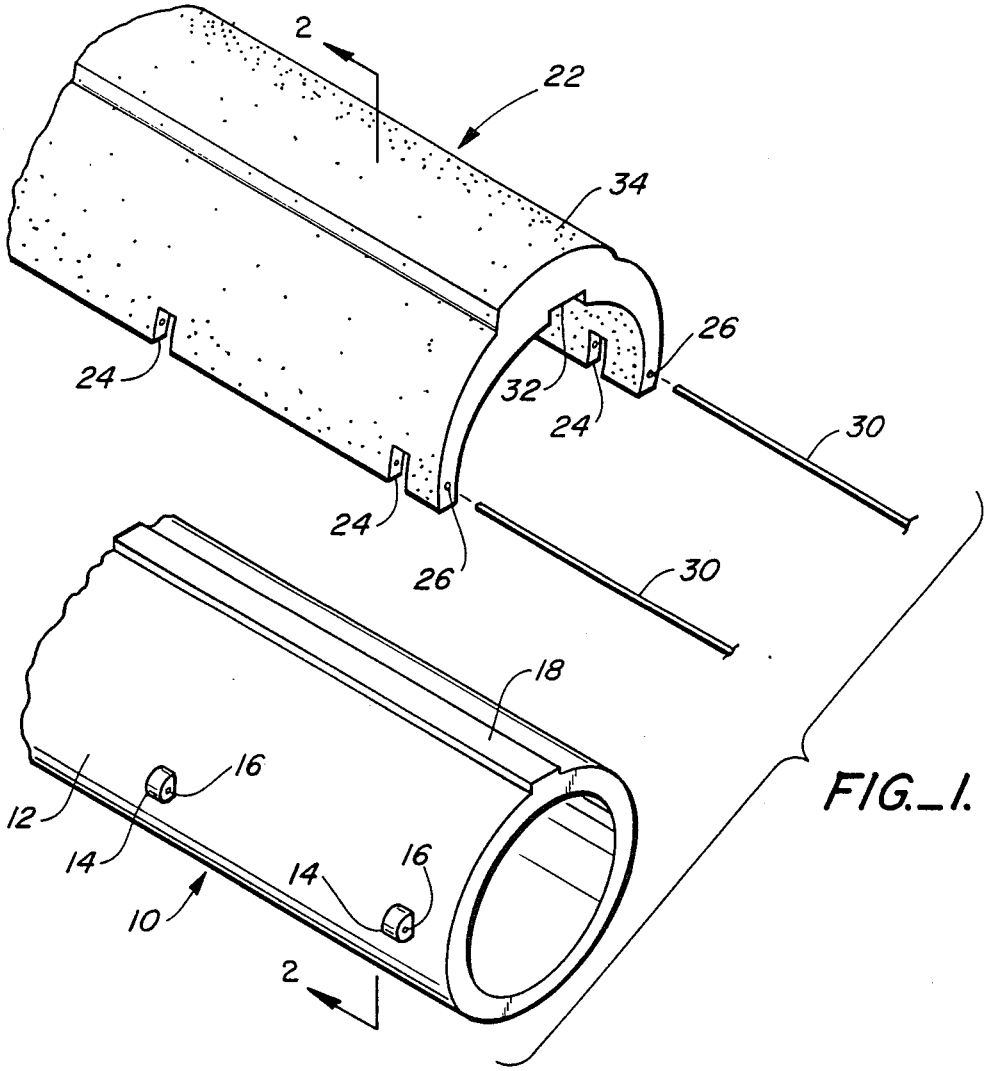
FIG. 1 is a fragmented, exploded view of the components of the present invention.
Figure 2:
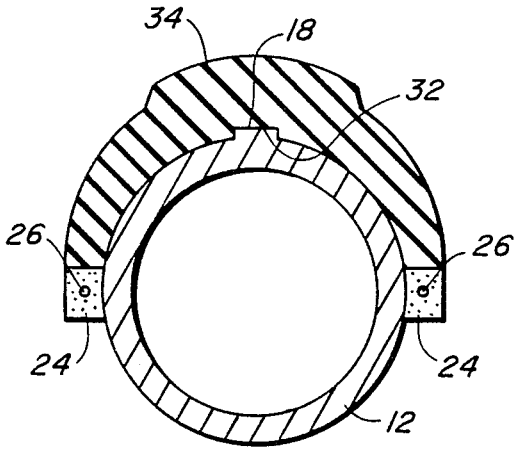
FIG. 2 is a cross-sectional view of the components taken along the line 2—2 of FIG. 1.
Figure 3:
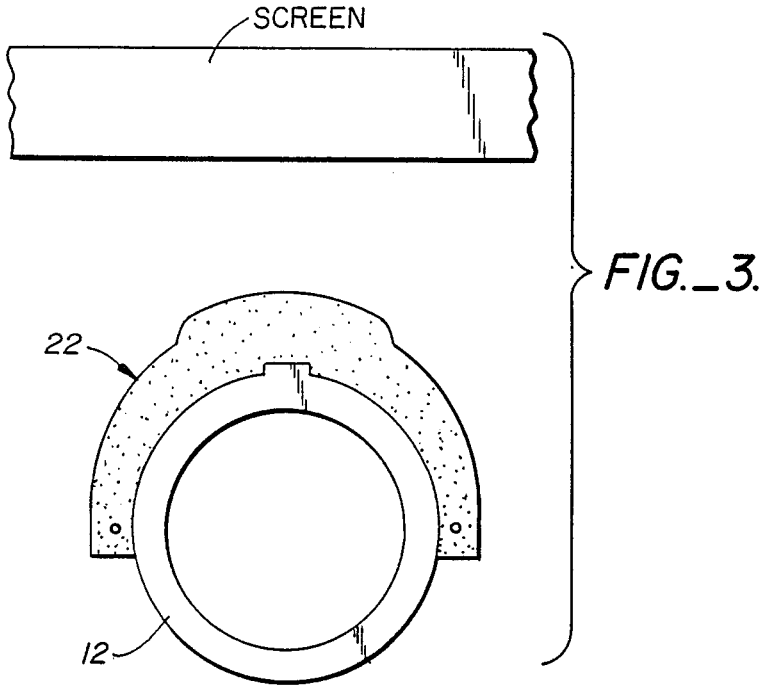
FIG. 3 is a view of the components of the invention when implemented under a sizing screen.

Vibrating rock sizing screens, or shaker screens as they are sometimes known, are often employed in conjunction with steel tubes disposed below the screen. During vibration of the screen, rocks and other material cascade downwardly therethrough and strike the tubes during the sizing operation. This results in a rapid wearing away of the tubes and the need for relatively frequent replacement.

Referring now to the drawings, the illustrated preferred embodiment of the present invention is to be substituted for the steel tubes conventionally used. The apparatus includes a rigid, elongated member 10 adapted to be positioned under a shaker screen (not shown) in a conventional manner. In the illustrated embodiment, elongated member 10 is in the form of a tube. It should, however, be appreciated that the elongated member may be solid, although this does, of course, greatly add to the weight thereof. The elongated member 10 is preferably constructed of steel.

Elongated member 10 has an outer peripheral surface 12 having a portion thereof adapted to face a sizing screen. Since member 10 is adapted to be disposed directly beneath a sizing screen, such portion is generally the top half thereof, ie. the portion susceptible to impact by rocks or other material dropping from the screen.

A plurality of spaced projections extend from the rigid, elongated member, said projections having apertures 16 therein. The projections 14 extend along the length of member 10 and form rows of aligned projections therealong. One such row is illustrated in FIG. 1 and it is to be understood that a similar row is arrayed along the side of member 10 not visible in that figure. At approximately mid-point of the portion of the member 10 adapted to face the sizing screen is an elongated key or a rib 18 which extends along the full length of the member.

The other principal component of the disclosed invention is a cover 22 formed of rubber or other suitable, abrasive-resistant material. The cover 22 is positionable over and covers the portion of member 10 adapted to face the sizing screen. Thus, the cover, when disposed under a shaker or sizing screen, will protect the rigid, elongated member 10 from the impact of material falling through the screen.

A plurality of recesses 24 are defined by cover 22. Such recesses are for the purpose of receiving projections 14 of elongated member 10.

Throughbores 26 are formed in the cover, and when the cover is positioned over elongated member 10 and projections 14 are in recesses 24, the throughbores are in alignment with apertures 16.

Means is provided for retaining projections 14 in recesses 24. In particular, the retention means comprises anchor pins 30 which pass through the throughbores and the apertures.

It will be appreciated that when cover 22 has been attached to elongated member 10, key 18 will be received by a key slot 32 formed in the cover. The key and key slot cooperate to prevent rotation of cover 22 relative to elongated member 10 under the impact of rock or other material falling thereon, thus preventing internal wear and abrasion of the cover.

The cover further includes an upwardly projecting protrusion 34 directly above key slot 32. This protrusion is located at the point on the cover most likely to receive the impact of rock from the screen disposed immediately thereabove. Such protrusion serves to prolong the life of the cover.

Because cover 22 is disposed over elongated member 10, the life expectancy of such elongated member may be greatly extended. Removal and replacement of such elongated members is a difficult task and through utilization of the teachings of the present invention, such replacement is minimized.

While it will be necessary from time to time to replace the cover because of wear, such an operation is a very simple one and does not require removal of elongated member 10 from the surrounding structure. Removal of a cover is simply accomplished by removing anchor pins 30 and pulling the cover away from member 10. Another cover may then be placed in position and secured to the elongated member.

Although the preferred form of cover 22 is that of a unitary structure extending the full length of elongated member 10, it will be appreciated that the cover may be comprised of individual cover segments extending along the length of member 10.

What is claimed is:

1. A device engageable by material falling through a sizing screen disposed over the device, said device comprising, in combination:

a rigid, elongated member having a primary axis and an outer cylindrically-shaped peripheral surface having an upper portion thereof adapted to face said sizing screen;

an open bottomed cover having a generally arc-like configuration formed of resilient, abrasive reistant material removeably mounted on said rigid, elongated member and extending partially about said cylindrically-shaped, outer peripheral surface and covering said outer peripheral surface portion to protect said rigid, elongated member from the impact of material falling through said screen onto said device;

a plurality of spaced projections extending from the outer peripheral surface of said rigid, elongated member, said projections having apertures therein and forming at least two rows of aligned projections extending along the length of said rigid, elongated member, said cover defining a plurality of recesses receiving said projections and throughbores in alignment with said projection apertures when said projections are received by said recesses;

anchor pins of elongate construction disposed parallel to the primary axis of said rigid elongated member and each passing through a plurality of said throughbores and said apertures; and means for preventing rotation of said cover on said rigid, elongated member, said rotation preventing means comprising a key slot formed in said cover and a key member projecting from said rigid, elongated member outer peripheral surface and positioned in said key slot, said cover being of increased thickness at a predetermined location thereon to define a protrusion over said key slot.

2. The combination of claim 1 wherein said cover is formed of rubber.

* * * * *